United States Patent [19]

Boller et al.

[11] Patent Number: 4,854,513

[45] Date of Patent: Aug. 8, 1989

[54] DEVICE AND METHOD FOR INTERMITTENTLY STORING AND RETURNING YARN DURING THE WINDING OF CONICAL BOBBINS FED WITH YARN AT CONSTANT SPEED

[75] Inventors: Giorgio Boller, Treviso; Sergio Montali, Roveredo In Piano; Luigi Colli, Pordenone, all of Italy

[73] Assignee: Savio, S.p.A., Pordenone, Italy

[21] Appl. No.: 169,396

[22] Filed: Mar. 17, 1988

[30] Foreign Application Priority Data

Mar. 19, 1987 [IT] Italy ..... 19754 A/87

[51] Int. Cl.[4] ..... B65H 54/06; B65H 54/10

[52] U.S. Cl. ..... 242/18 R; 242/18 DD; 242/154

[58] Field of Search ..... 242/18 DD, 18 R, 45, 242/147 R, 153, 154, 25 R

[56] References Cited

U.S. PATENT DOCUMENTS

| | | | |
|---|---|---|---|
| 3,300,161 | 1/1967 | Hermans | 242/154 |
| 3,640,477 | 2/1972 | Furst | 242/18 DD X |
| 4,002,306 | 1/1977 | Raasch | 242/18 DD X |
| 4,083,506 | 4/1978 | Mander et al. | 242/25 R |
| 4,113,193 | 9/1978 | Raasch et al. | 242/18 DD X |
| 4,133,493 | 1/1979 | Schewe | 242/154 |
| 4,312,482 | 1/1982 | Schewe | 242/154 |

FOREIGN PATENT DOCUMENTS

| | | |
|---|---|---|
| 8527472 | 11/1985 | Fed. Rep. of Germany . |
| 810482 | 3/1956 | United Kingdom . |
| 2125072 | 2/1984 | United Kingdom . |

OTHER PUBLICATIONS

Wire and Wire Products (US), Somerset, vol. 37, Apr. 1962, pp. 496–503, 538, 539.

*Primary Examiner*—Stanley N. Gilreath

*Attorney, Agent, or Firm*—Hedman, Gibson, Costigan & Hoare

[57] ABSTRACT

A yarn storage and return device for yarn being wound on a conical bobbin driven at a constant speed. The device comprises a lever system for storing and returning the yarn and for regulating and monitoring the amount of stored yarn. The yarn is drawn into the storage position by an arm of the lever system and is then released (i.e. returned) from this storage position. This returning operation releases the yarn from its storage position and replaces it (returns it), to its normal feed path. The device also comprises a transducer, and electric comparator, and an electronic processor control unit to convert, compare, and process an electric controlling signal to activate a drive motor. The drive motor actuates a tensioning element which affects the storage operation of the device.

4 Claims, 1 Drawing Sheet

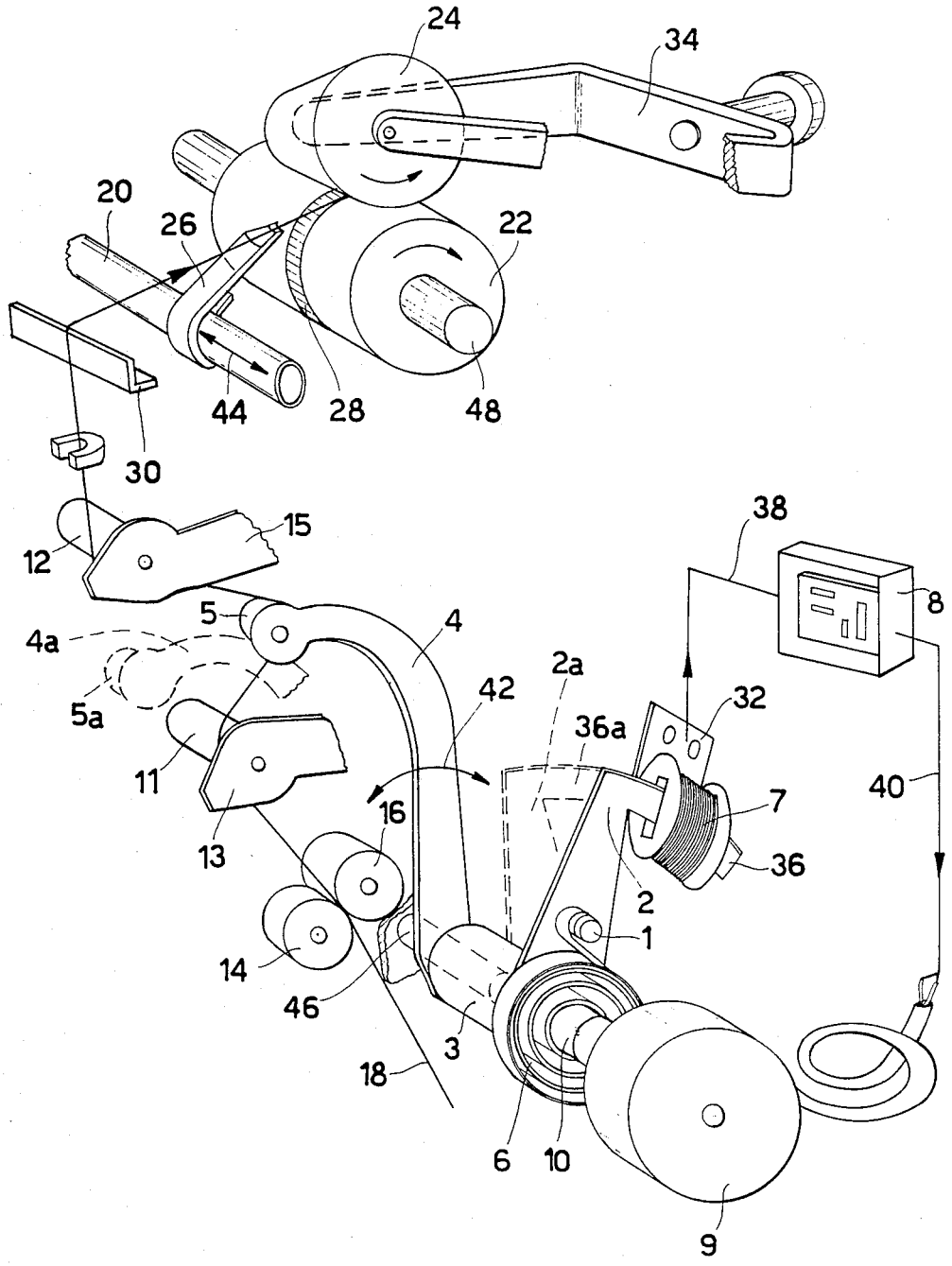
24
34
20
26
22
44
28
48
30
12
15
38
8
5
4
4a
5a
42
2a
32
36a
11
40
7
16
13
36
2
1
14
46
3
18
6
10
9

DEVICE AND METHOD FOR INTERMITTENTLY STORING AND RETURNING YARN DURING THE WINDING OF CONICAL BOBBINS FED WITH YARN AT CONSTANT SPEED

The invention relates to a device and method for intermittently storing and returning yarn during the winding of conical bobbins with yarn withdrawn at constant speed from individual spinning units. More particularly, the invention relates to a yarn storage and return device in which storage capability for the intermittent supply of yarn and a tension compensator and regulator for the yarn being wound are combined.

In spinning units, the yarn emerges at its outlet at constant speed from the feed rollers and must be deposited at a speed which varies between the major diameter and minor diameter of the conical bobbin being formed.

In such a working process it is therefore necessary to periodically vary the yarn length in the section between the feed rollers and its point of deposition on the circumference of the conical bobbin. This length variation and the consequent variation in yarn tension are compensated by adjusting the yarn path by means of a winding tension regulator and compensator device.

Tension compensators are known in the art. They comprise a deflecting roller connected to a rocker arm. Depending on the instantaneous yarn tension, or rather according to the instantaneous position of the rocker arm, the mobile deflecting roller is deviated to a varying extent from its contact or bearing position, this position being assumed by the action of a force exerted by a counterweight, a spring or a similar elastic element. These yarn tension compensators have the drawback of exerting an elastic opposing force which cannot be controlled to take account of the tension variations which can occur in the yarn in the case of non-regular storage.

In this respect, in said devices a constantly rotating substantially cylindrical drive roller rotates the conical bobbin under formation, the dimensions of which, together with the taper and angle of the winding helix determine the angular swing amplitude of the mobile arm.

The swing position of this latter, which keeps a roller connected to it constantly adhering to the yarn, determines the yarn storage, which constantly increases and decreases according to the stage in the progress of the entire yarn storage and return cycle. Any slippage between the drive roller and bobbin under formation, which frequently occurs due to the friction drive used, increases the length of yarn stored and changes the swing position of the mobile arm which, under the action of the elastic element acting in a pulling capacity, is moved in the limit into an abutting position, consequently nullifying the tension of the yarn being collected. Thus without tension, the yarn leaving the winding rollers winds with irregular turns, so prejudicing the bobbin formation and in the limit twisting about itself to create knots and tangles such as to compromise the yarn consistency. The tangled yarn also frequently creates obstacles which interrupt yarn continuity, so blocking the spinning process. The high yarn formation rate of spinning units means that any production hold-up in such spinning units assumes considerable importance because of the reduced rate of yarn collection in the form of bobbins.

Yarn tension compensators of this type also have the drawback that if the yarn count or thickness, the type of bobbin under formation or the winding helix angle varies, they have to be adapted to this by onerous manual adjustments at the individual spinning stations, or by replacing the elastic element with another elastic element which conforms to the different operating characteristics. These devices are therefore inflexible in use.

Devices for storing and intermittently returning yarn, preferably for textile machines, are also known. These include by way of example the devices described and claimed in the German patents DE 1785153 and DE 1454917.

Such devices have numerous drawbacks: they are insensitive to tension and even less to tension variations in the winding yarn because the storage and return element is of a type which, by means of a lever system, is completely controlled by a to-and-fro drive rod which passes along the entire machine face to operate the yarn stores of all the spinning units; they are unable to adjust the yarn tension to one or more predetermined values preset according to the type of yarn being collected or of the bobbin under formation; they present considerable difficulty in adjusting the value preset for the storage of the yarn being wound, as this adjustment must be made manually by an operator by adjusting the length of the connecting rods or the positions of the lever rotation pivots in order to vary the lever arms, and is therefore lengthy, laborious and variable according to the geometrical characteristics of the bobbin under formation and the winding helix angle; they also have a rather high inertia force due to the presence of several lever systems which are mobile simultaneously but intermittently, and tend to trigger uncontrollable vibratory oscillation and at the same time limit the collection rate; they also set limits on the machine length and therefore on the number of spinning units as their operation relies on drive rods which have to extend along the face of the collection units and are subjected to large numbers of to-and-fro movement strokes. These devices are also rather bulky and inefficient when slippage is present between the conical bobbin under formation and the drive roller. This slippage, which is more or less accentuated, is often present because the conical bobbin being cross-wound continuously rests against a drive roller which on a determined but narrow part of its surface possesses a friction band used for friction drive purposes.

A further drawback of such devices is the presence of mobile members, such as rods or shafts, which have to be provided and mounted at the commencement of machine construction, and cannot be fitted later.

Said mobile members control the operation of several storage devices and extend along the entire winding face from a position at the head of the machine. Because of the principle on which they are constructed, these devices are therefore inflexible and unadaptable to preexisting spinning stations or stations not provided with the aforesaid mobile members which pass along the front structure of the entire collection face.

An object of the present invention is to obviate the aforesaid drawbacks by providing an intermittent storage and return device wherein yarn is drawn into the storage position and is then released from this storage position (i.e. returned). This returning operation releases the yarn from its storage position and replaces it (returns it), to a normal feed path. This device, winding conical bobbins fed with yarn at constant speed has the following advantages:

enables the stored length to be always maintained within a preset range of values with only limited variations in yarn tension allows the immediate takeup of any additional yarn lengths accidentally present due to slippage between the drive roller and conical bobbin under formation does not limit the yarn collection speed in the formation of conical bobbins does not set limits on the machine length and thus does not limit the number of winding units to be positioned side by side, as these do not require for their operation any drive member extending along the entire winding face, and therefore do not possess further masses moving longitudinally to the machine and connected to drive rods subjected to reciprocating to-and-fro movement does not limit the diameter of the bobbins obtainable and does not require laborious adjustment to be made when changing the taper of the bobbin under formation has extreme operational flexibility such as to allow a range of application enabling soft or compact bobbins to be made up within a vast range of yarn counts without the need for laborious mechanical adjustments can be applied without the need for extensive demounting and remounting of the component parts of the winding machine if this, being already set for forming cylindrical bobbins, is to be converted for forming conical bobbins can be easily disengaged so as to make it possible to form both conical and cylindrical bobbins on the same machine.

A further object of the present invention is to provide a yarn storage and return device in which a store for the intermittent feed of yarn and a tension compensator and regulator for the yarn being wound are combined, in a manner requiring very little maintenance.

These and further objects are all attained by the yarn storage and return device of the present invention, in particular for textile machines operating to form conical bobbins, characterised by comprising:

a double arm lever system having the ability to move with swing motion about an axis by means of a bush positioned as a rigid element joining together said arms, of which one acts as a yarn storage and return element and, at the same time, as a tension compensator and regulator element for the yarn being wound, and the other acts as a linear position element of a system for controlling and monitoring the effective length of yarn stored moment by moment during the entire to-and-fro cycle of the yarn guide element an analog or digital transducer which converts the position of the end of the arm operating as a linear position element into an electrical signal or series of electrical signals an electric comparator which compares said electrical signal or said electrical signals with one or more reference signals, these latter being related to predetermined values preset to give regular storage, in order to generate a control signal when a signal arises which is of a value different from the preset value or values an electronic control unit, in the form of a processor means of known type, which converts said control signal into a signal which activates the operation of a drive source a drive source which, under the influence of said control signal, increases or decreases the preloading of the elastic element in order to adjust the storage arm to a yarn tensioning value which is slightly higher or slightly lower than its previous value, in order to rapidly restore the storage swing to within the range of values corresponding to regular storage, this latter being predetermined as a function of the geometrical parameters of the winding underway.

According to one embodiment, the device is present individually in each yarn winding position.

According to a further embodiment, the device has no link with the yarn guide element or with the support element for the bobbin under formation, and is therefore independent of the fullness of the bobbin itself.

The device according to the invention has the advantage, for any variation in the type of yarn and for any variation in the geometrical characteristics of the winding or of the bobbin to be obtained, of automatically adjusting and setting the tension of the yarn being collected to a corresponding value for obtaining regular storage and return swings in accordance with the preset values and limits.

A further advantage of the device according to the invention is that it allows the response and speed of operation of the drive source when angularly rotating the shaft to obtain an increase in the preloading of the elastic element to be greater than the response and speed of operation of the drive source when angularly rotating the shaft to obtain a reduction in the preloading or a slackening of the elastic element.

A further advantage of the invention is that it ensures that once actuated by the drive source or by any actuator, the rotations in both directions for the purpose of varying the preloading of the elastic element are perfectly irreversible so that the thrust of the elastic element against the shaft or the vibration of the machine when in operation are unable to minimally modify the extent of said actuated rotations.

A preferred embodiment of the device of the present invention is described hereinafter by way of non-limiting example with reference to the single accompanying FIGURE.

This is a diagrammatic isometric view of the intermittent storage and return device of the present invention cooperating with the yarn guide element, the bobbin under formation being driven by the friction band of the drive roller, the FIGURE showing the moment of maximum storage in the yarn travel while the yarn guide element is moving in the increasing diameter direction of the cross-wound bobbin.

In the single figure: the reference numeral 1 indicates the connection pin of the outer eye of the spiral elastic element 6. Said pin 1 is rigidly fixed in an integral manner to the mobile arm 2; 2 is the mobile arm of the yarn compensation and return lever system, which operates as the linear position element of a system for controlling and monitoring the effective length of yarn 18 stored; **2*a* is the position which the mobile arm 2 assumes at that moment during its swing movement when the stored yarn length 18 is zero or a minimum; 3 is the bush or ring which rigidly joins together the two mobile arms 2 and 4 of the yarn storage and return lever system; 4 is that mobile arm of the yarn compensation and return lever system which operates as the actual storage and return element for the yarn 18 while also acting as the tension compensation and adjustment element for the yarn 18 being wound; 4*a* is the position which the mobile arm 4 assumes at that moment during its swing movement when the stored length of yarn 18 is zero or a minimum; 5 is a yarn deflecting and guide roller which moves with swing movement by being rigid with the end of the mobile arm 4 but is able to rotate about itself so as not to generate grazing friction against the yarn 18 undergoing continuous collection. It has a substantially cylindrical profile; 5***a* is the position which the mobile yarn deflecting and guide roller 5 assumes at that moment during its swing movement when the stored yarn length 18 is zero or a minimum; 6 is the spiral elastic element which stores drive energy by means of appropriate deformation resulting from its loading by angular rotation applied by the shaft 10 which is connected to its inner end. It consists of a steel strip or wire or a like steel shape; wound substantially as a flat Archimedes spiral and exerts a reaction force corresponding to the deformation which it undergoes; 7 are the coil windings of an analog or digital transducer or other optical or magnetic position sensor able to convert the position of the curved anchor-shaped end 36 of the mobile arm 2 into an electric signal or a series of electric signals; 8 is central unit which combines an electrical comparator with an electronic microprocessor. Said central unit processes the data originating from the analog or digital transducer comprising the coil 7 and mobile core 36, to then activate a drive source 9 when regularizing the yarn storage 18; 9 is the drive source which operates the shaft 10, it consisting of a pneumatic, hydraulic or electrical actuator or a combination of two or more of these types; 10 is a shaft rotated angularly by the drive source 9 to vary the preloading of the spiral elastic element 6 for the purpose of regularizing the storage if this has strayed outside the range of preset values. Said shaft is fixed or hinged, at or in proximity to its end, to the inner end of the spiral elastic element 9; 11 is a fixed yarn deflecting and guide roller having a substantially cylindrical profile and connected rigidly to the base plate 13.

It is free to rotate about itself to not generate grazing friction against the yarn 18 undergoing continuous collection movement; 12 is a fixed yarn deflecting and guide roller of substantially cylindrical profile connected rigidly to the base plate 15. It is free to rotate about itself; 13 is the base plate for the roller 11, and is fixed to the machine structure which is otherwise not shown; 15 is the base plate for the roller 12 and is fixed to the machine structure which is otherwise not shown; 14 and 16 indicate a pair of rollers positioned along the path of the yarn 18, both rollers being pressed against each other with said yarn 18 passing between them to withdraw it from a spinning unit of a rotor spinning machine and feed it from its outlet towards the compensator device of the present invention at constant speed; 18 is the collected yarn subjected to storage and return at the outlet of the pair of feed rollers 14 and 16; 20 is a solid or hollow shaft of substantially circular cross-section which is operated as a control rod for the yarn guide elements 26 by means of a suitably shaped cam so as to transmit a movement of suitable kinematic and dynamic characteristics to said thread guide elements 26; 22 is the drive roller for rotating the conical bobbin 24 under formation; 24 is the cross-wound yarn bobbin under formation; 26 is the yarn guide element driven with reciprocating to-and-fro motion by the drive shaft or rod 20, this latter extending along the entire operational winding face; 28 is the friction region in the form of a circular band of limited width, for driving a conical bobbin by the drive roller 22; 30 is a blade for deflecting the path of the yarn 18. Said blade can be linear or shaped with more or less accentuated profiles already known to the art; 32 is the base plate for supporting the coil windings 7 of the analog or digital transducer; 34 is the bobbin carrier arm which supports the yarn package 24; 36 is the end of the mobile arm 2, said end forming the mobile core of the analog or digital transducer; 36*a* is the position which the anchor-shaped end 36 assumes at that moment during its swing movement when the stored yarn length 18 is zero or a minimum; 38 is the connection cable between the transducer, which generates electrical signals proportional to the linear position of the end 36, and the central unit 8; 40 is the connection cable between the central unit 8 and the drive source 9; 42 represents the swing path of the mobile arm 4; 44 represents the reciprocating to-and-fro movement path of the shaft 20; 46 is the shaft or pivot about which the yarn storage and intermittent return lever system swings by way of the bush coupling 3; 48 is the drive shaft which extends along the entire winding face.

The operation of the device according to the invention is as follows.

The purpose of the storage and return device for the yarn 18 being wound onto the conical bobbin 24, according to the invention, is to adapt the varying winding speed deriving from the taper of the bobbin 24 to the constant outlet speed from the feed rollers 16 and 14. The average winding speed corresponds substantially to the spinning speed of the spinning chamber. When the yarn 18 is being collected on the minor diameter of the bobbin 24 the winding speed is less than the feed speed from the extracting rollers 14 and 16, and the lever system by means of its mobile arm 4 stores a suitable length of yarn 18. This stored length is returned gradually as the collection speed increases on moving the yarn towards the major diameter of the bobbin 24 by means of the yarn guide element 26.

The ratio of the minor diameter to the major diameter of the bobbin 24 under formation determines the maximum length of yarn 18 which has to be stored and then returned for each complete cycle of the yarn guide element 26.

As said ratio decreases continuously with increasing fullness of the bobbin 24 under formation, the amplitude of the swing movement of the mobile yarn deflecting and guide roller 5 also decreases for decreasing storage of yarn 18.

The mobile deflecting roller 5 generates a loop by deflecting the yarn 18 from its path. This loop therefore has a continuously varying amplitude and the device of the present invention automatically controls this loop by acting as a compensator for the periodic tension variations which arise as a result of the periodic winding speed variations in the formation of a conical bobbin.

In order to compensate said tension variations to which the collected yarn 18 is subjected and level them out to a substantially constant value, the mobile deflecting roller 5, which drags the yarn into a temporary storage loop by means of the swing movement of the mobile arm 4, has to assume different positions within a certain range of swing movement positions, relative to the fixed deflecting rollers 11 and 12.

These latter, which are rotatable, provide precise guiding of the yarn 18 by virtue of their shape.

Because of the rigid connection between the two mobile arms 2 and 4, this variation in the position of the mobile deflecting roller 5 also varies the position of the anchor-shaped end of the lever 2.

Said end, which moves without making contact, forms the mobile core of a coil comprising the windings 7 of a linear transducer. This latter generates at its output a signal or several signals of electrical nature which are fed through the connecting cable 38 to the central unit 8 which compares and processes said signals. If during the continuous winding process the storage swing remains within predetermined preset limits, the instantaneous mobile linear position of the anchor-shaped end 36 generates electrical signals which when processed in the central unit 8 confirm that the storage and return cycles of the yarn 18 are regular. Thus no signal is generated at the output of the central unit 8 and no activation signal is therefore fed to the drive source 9. If during the continuous winding process the storage swing strays outside the predetermined preset limits, the corresponding mobile linear position of the anchor-shaped end 36 generates an electrical signal or signals which after suitable comparison and processing in the central unit 8 give instant rise to an output signal which activates the drive source 9. This latter angularly rotates the shaft 10 to vary the preloading of the spiral elastic element 6 in order to rapidly return the storage to within the limits of the predetermined preset range.

This latter operation can be further clarified as follows. If the mobile deflecting roller 5 causes the loop in the yarn 18 to assume a position which exceeds the maximum storage limit allowed by the predetermined range of swing for regular operation, the drive source 9 is operated and rotates the shaft 10 angularly in the direction which slightly reduces the amount of preloading of the spiral elastic element 6. This latter element therefore slackens and compels the yarn 18, by means of the lever system 2, 3 4 and 5, to collect on the conical bobbin under an average tension which is slightly lower than the preceding situation. This reduction in the average tension of the yarn 18 being continuously wound must be sufficiently gradual to not allow the formation of knots, tangles or similar defects which if collected on the bobbin would reduce its quality. By only slightly decreasing the average tension of the yarn 18 being wound, the yarn slackens and becomes less inserted into the already deposited layers of yarn, and therefore proceeds to wind in the form of turns having a slightly greater diameter.

These turns rapidly and progressively take up the excessive storage created by a multiplicity of factors.

If the mobile deflecting roller 5 causes the loop in the yarn 18 to assume a position below the minimum storage limit allowed by the predetermined range of swing for regular operation, the drive source 9 is operated and rotates the shaft 10 angularly in the direction which slightly increases the amount of preloading of the spiral elastic element 6. This latter element therefore tightens and compels the yarn 18, by means of the lever system 2, 3, 4 and 5 to collect on the conical bobbin under an average tension which is slightly higher than the preceding situation. This increase in the average tension of the yarn 18 being continuously wound can be substantially rapid as there is no danger of forming knots, tangles or similar defects. By only slightly increasing the average tension of the yarn 18 being wound, the yarn tightens and becomes more inserted into the already deposited layers of yarn, and therefore proceeds to wind as turns having a slightly smaller diameter. Such turns rapidly and progressively cause the yarn to store in the form of an increasingly larger loop, with the result that the intermittent swing of the mobile arm 4 again falls within the limits of the range of swing for regular operation. The width of said regularity range is predetermined and preset by the geometrical characteristics of the winding being made and the geometrical characteristics of the conical bobbin 24 under formation. The applicant has found that the device for intermittently storing and returning yarn during the winding of conical bobbins fed with yarn at constant speed, according to the present invention, operates very reliably and periodically compensates the variations in yarn tension without the mobile deflecting roller 5 undergoing uncontrollable swing. Thus, the yarn is drawn into the storage position when the tension is low and subsequently released from this storage position, i.e. returned, when the tension is high. This returning operation releases the yarn from its storage position and replaces it (returns it), to its normal feed path.

The use of the device according to the invention is not limited to the winding of conical bobbins produced on a rotor spinning unit, but can also be advantageously applied to the winding unit of any winding apparatus.

A preferred embodiment has been described herein but it is apparent that other embodiments are possible which fall within the scope of the present invention.

Thus the positions of the operating lever systems can vary; different drive arrangements can be provided; it is also possible to vary the shapes and dimensions of the yarn deflecting-storage roller together with the arms which undergo swing movement; ratios and dimensions of the various operational elements can also vary; modifications of a practical applicational nature can be made; thus for example a mechanical-pneumatic transducer can be used instead of an electromechanical transducer; the position of the storage lever system can also be sensed by an optical rod or bar, or by one or more optical sensors in cooperation with bar codes; this latter position, which is converted into an electric signal and processed as heretofore described, can also be sensed on a circumferential arc close to or in correspondence with the axis of rotation of the storage lever mechanism so as not to be influenced by any small vibrations which arise during passage of the yarn; all without leaving the scope of the inventive idea as claimed hereinafter.

We claim:

1. A yarn storage and return device for yarn being wound on a conical bobbin driven at a constant speed comprising:

(a) a lever system including a shaft, an elastic element, and a pair of arms, which are connected to and move with each other, through which said shaft passes, and which can swing around the axis defined by said shaft, wherein said pair of arms include a first arm acting as a yarn storage and return means and a tension compensator and a regulator for the wound yarn, and a second arm acting as a linear positioning means for controlling and maintaining the effective length of the yarn stored by said first arm during the entire bobbin formation;

(b) a transducer responsive to the position of said second arm for converting the position of the end of said first storage and return arm into one or more signals for indicating the position of said first storage and return arm;

(c) an electric comparator for comparing said electrical signal of said transducer with one or more reference signals which define the predetermined range of swing of said first storage and return arm, for generating a control signal when the range of swing is outside the predetermined range;

(d) an electronic control processor unit for converting said control signal generated by said comparator into an activating signal; and (e) a drive source for adjusting the loading on said elastic element according to said activating signal from said electronic control processor unit for varying the tension of said first storage and return arm to restore the swing of said arm to within its predetermined range.

2. The device of claim 1, wherein the elastic element is spiral.

3. In an apparatus for winding yarn on a conical bobbin driven at a constant speed, including a guide for guiding the yarn onto the bobbin and a support for supporting the bobbin, a device for storing and returning yarn being wound on the bobbin independent of said guide and said support, wherein the device comprises:

(a) a lever system including a shaft, an elastic element, and a pair of spaced apart arms which are rigidly joined by a bushing through which said shaft passes, and which can swing around the axis defined by said shaft, wherein said pair of arms include a first arm acting as a yarn storage and return means and a tension compensator and a regulator for the wound yarn, and a second arm acting as a linear positioning means for controlling and maintaining the effective length of the yarn stored by said first arm during the entire bobbin formation;

(b) a transducer responsive to the position of said second arm for converting the position of the end of said first storage and return arm into one or more signals for indicating the position of said first storage and return arm;

(c) an electric comparator for comparing said electrical signal of said transducer with one or more reference signals which define the predetermined range of swing of said first storage and return arm, for generating a control signal when the range of swing is outside the predetermined range;

(d) an electronic control processor unit for converting said control signal generated by said comparator into an activating signal; and (e) a drive source for adjusting the loading on said elastic element according to said activating signal from said electronic control processor unit for varying the tension of said first storage and return arm to restore the swing of said arm to within its predetermined range.

4. A method for storing and returning yarn being wound on a conical bobbin driven at a constant speed comprising the steps of:

(a) driving a lever system means having a storage and return arm means for storing and returning yarn, for compensating and regulating the wound yarn, and for controlling and monitoring the effective length of the yarn stored during the entire bobbin formation;

(b) converting the position of the yarn storage and return means of said lever system into one or more electrical signals by a transducer means for indicating the position of said storage and return means;

(c) comparing said electrical signal of said transducer means with a reference signal and generating a control signal by an electric comparator means when said electrical signal deviates from said reference signal;

(d) converting said control signal from said electric comparator means into an activating signal by an electronic control processor unit means; and (e) adjusting the loading on a spiral elastic element of said lever system means by a drive source means according to said activating signal from said electronic control processor unit means.

* * * * *